US005473518A

United States Patent [19]

Haber et al.

[11] Patent Number: 5,473,518

[45] Date of Patent: Dec. 5, 1995

[54] REMOVABLE FLASHING LIGHT HOUSING FOR AN ATHLETIC SHOE

[76] Inventors: Terry M. Haber, 25011 Castlewood, El Toro, Calif. 92630; William H. Smedley, 33285 Blanche Dr., Lake Elsinore, Calif. 92330; Clark B. Foster, 23631 Wakefield Ct., Laguna Niguel, Calif. 92677

[21] Appl. No.: 201,853

[22] Filed: Feb. 25, 1994

[51] Int. Cl.[6] ..... F21L 15/08

[52] U.S. Cl. ..... 362/103; 362/186; 362/191; 362/234; 362/396; 36/137

[58] Field of Search ..... 36/132, 136, 137, 36/139; 362/103, 104, 186, 190, 191, 234, 396

[56] References Cited

U.S. PATENT DOCUMENTS

| | | | |
|---|---|---|---|
| 1,184,396 | 5/1916 | Trimble | 36/137 |
| 1,597,823 | 8/1926 | Randolph | 362/103 |
| 2,233,544 | 3/1941 | McKinley | 36/137 |
| 2,557,663 | 6/1951 | Knode | 36/137 |
| 2,671,847 | 3/1954 | Lerch | 362/103 |
| 4,412,205 | 10/1983 | Von Kemenczky | 36/137 |
| 4,438,482 | 3/1984 | Leon et al. | 362/103 |
| 4,597,197 | 7/1986 | Strasinger | 36/136 |
| 4,651,446 | 3/1987 | Yukawa et al. | 36/132 |
| 5,149,489 | 9/1992 | Crews | 36/137 |

FOREIGN PATENT DOCUMENTS

| | | | |
|---|---|---|---|
| 1021950 | 2/1953 | France | 36/137 |
| 1205059 | 1/1960 | France | 362/103 |

*Primary Examiner*—Ira S. Lazarus
*Assistant Examiner*—Alan B. Cariaso
*Attorney, Agent, or Firm*—Hawes & Fischer

[57] ABSTRACT

A flashing light housing that is adapted to be removably attached to the rear (i.e. heel) of any shoe, such as, for example, a sneaker, sport shoe, training shoe, or the like, without requiring factory alterations to the shoe. A manually accessible light control switch is operable by the wearer to selectively control the energization of a flashing light source that is carried at the interior of the housing. An attachment hook extends from the housing to fit over the top of and around the heel of the shoe, whereby the housing will be suspended from the heel. A resilient attachment band is connected to and extends outwardly and in opposite directions from the flashing light housing. The attachment band is adapted to be fastened to the sole of the shoe at each of a first side and an opposite side thereof, whereby to hold the housing against the heel. By virtue of the foregoing, the flashing light housing is characterized by a large viewing area that is easily visible to on-lookers.

16 Claims, 5 Drawing Sheets

*fig.* 1

REMOVABLE FLASHING LIGHT HOUSING FOR AN ATHLETIC SHOE

BACKGROUND OF THE INVENTION

1. Field of the Invention

This invention relates to a flashing light housing that is adapted to be removably attached to the rear (i.e. heel) of any athletic shoe (such as, for example, a sneaker, sports shoe, training shoe, or the like) to permit the wearer to selectively control the energization of a flashing light source carried at the interior of the housing.

2. Background Art

Athletic shoes are known for carrying a battery powered light module within a relatively narrow, factory preformed cavity in the heel of the shoe. The conventional light module often requires a certain heel-strike pressure to close the contacts of a force sensitive switch in order to complete an electrical circuit between a power supply and a light source. Consequently, no light will be produced by the light module if the wearer is either standing still or walking slowly. In this regard, unless the athletic shoes are subjected to a threshold force, nothing will be visible to warn on-lookers of the wearer's presence in those cases where the shoes are worn at night and a safety factor is intended. Moreover, the conventional light modules are carried at or near the bottom of the heel so as to be located adjacent the roadway or other surface to be traveled over by the wearer. The aforementioned position of the light module relative to the roadway limits the size of the area illuminated and visible to on-lookers.

What is more, the light module is not easily removed from its cavity in the heel of the athletic shoe when it is necessary to change the battery. That is, a tool is frequently required to pry the module out of its cavity. Thus, it may not be completely safe for many individuals, particularly young children, who, to a large extent, wear such athletic shoes to use sharp or pointed tools to remove the light module. However, even if the light module is removed, it is not transferable to other athletic shoes which do not include a preformed cavity. Hence, the life of the light module, which contributes to the overall cost of the shoe, is generally limited to the life of the shoe within which it is carried. In the case of children, athletic shoes are often worn out after only six months or less which would, in effect, necessitate that a pair of new light modules be purchased with a new pair of shoes, even if the modules in the old shoes were still in working order.

In addition, the conventional light modules have no means to permit the wearer to control the energization of the light source therewithin. That is to say, the light source will operate on a continuous basis whether or not such operation is desired. This continuous operation of the light source contributes to a reduction in the life of the battery as well as the necessity of making frequent and inconvenient battery changes. Because of the low profile of the conventional light module that is carried within the correspondingly narrow cavity at the heel, a relatively expensive lithium battery source is often used. Therefore, the original purchase price of the athletic shoe is increased as is the cost to maintain the shoe as a consequence of replacing dead batteries.

SUMMARY OF THE INVENTION

A flashing light housing is disclosed that is adapted to be removably attached to any shoe, such as, for example, a sneaker, sports shoe, training shoe, or the like. Thus, the light housing may be advantageously and cost effectively transferred from one shoe to another, particularly when the original shoe is to be discarded due to wear. The flashing light housing comprises a base which receives the flashing light electronics including a pair of disposable, low cost AAA batteries, a plurality of light emitting diode light sources, and a flashing light circuit by which to connect the batteries to the light sources.

A transparent lens is secured atop the base of the flashing light housing to cover and protect the electronics therebelow. An attachment hook projects upwardly from the base of the housing. A pair of elongated slits are formed at opposite sides of the lens of the housing to receive a laterally extending attachment strap therethrough. The attachment strap has a pair of oppositely projecting side bands, each side band having a hole formed therein. A light control button projects from the housing and extends upwardly through an opening in the lens to permit the wearer to open a switch connected in the flashing light circuit between the batteries and the light sources to reduce both battery consumption and replacement during periods of non-use.

To attach the flashing light housing to a shoe without requiring any factory alterations thereto, the attachment hook of the base is first placed over and around the top of the heel such that the lens is suspended at approximately the middle of the heel, whereby the area of illumination visible to on-lookers can be maximized. Next, a pair of threaded, screw-like fasteners are positioned through respective holes in the side bands of the attachment strap to be inserted at opposite sides of the sole for holding the housing against the heel. The wearer may then operate the light control button to selectively illuminate the light emitting diodes and thereby provide a continuous and bright flashing light display through the lens whether the wearer is moving or standing still.

DETAILED DESCRIPTION

Figure 1:
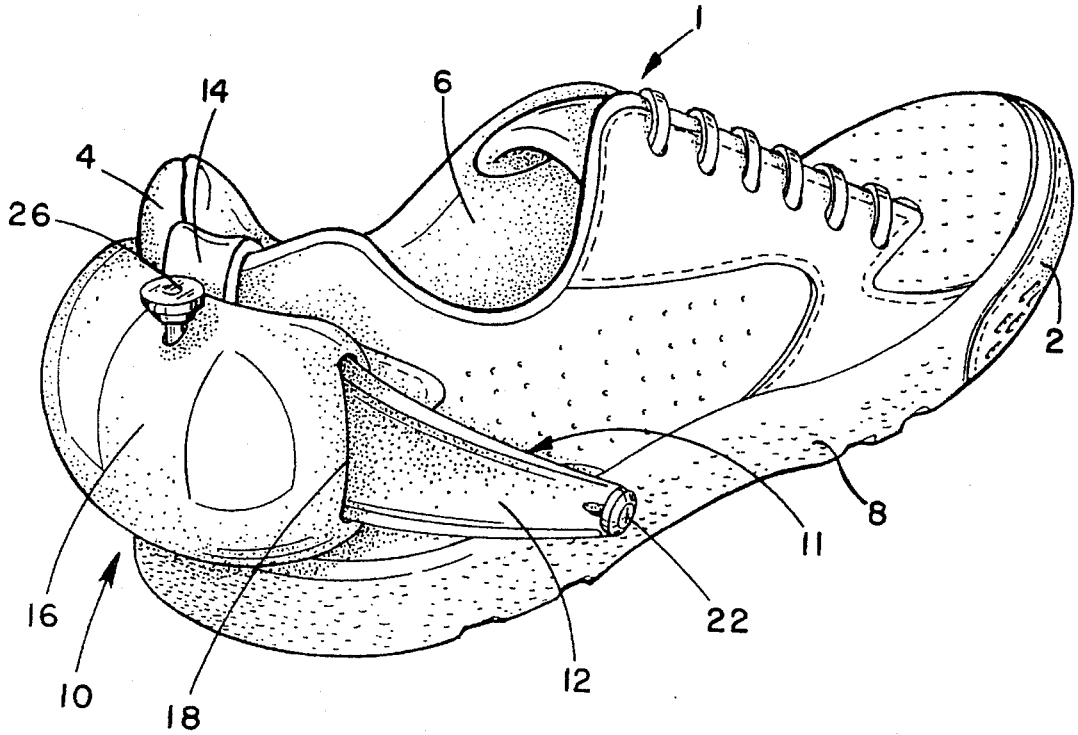
FIG. 1 is a perspective view showing the flashing light housing which forms the present invention removably attached at the rear of an athletic shoe.
Figure 3:
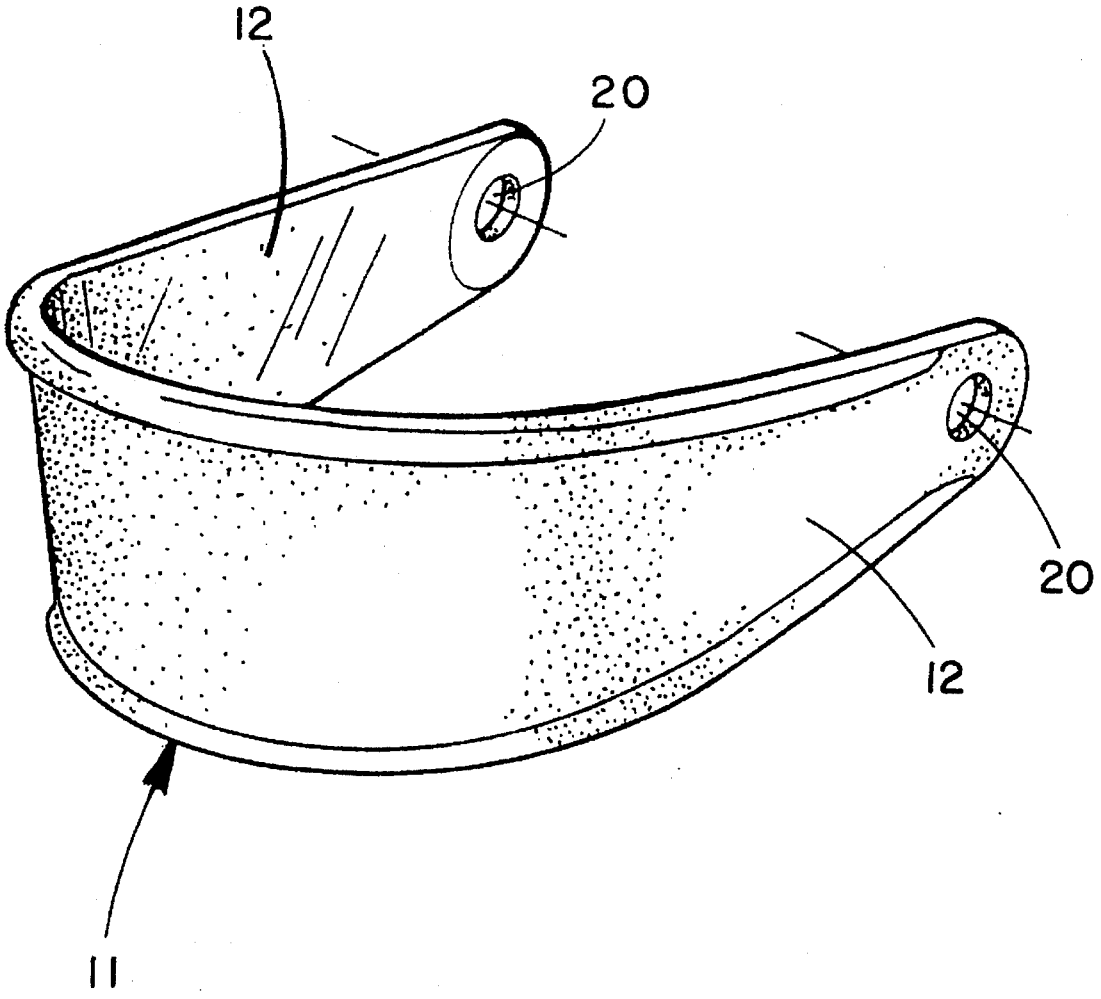
FIG. 3 shows an attachment strap for removably attaching the flashing light housing to the athletic shoe.

The removable flashing light housing 10 which forms the present invention is now described in detail while referring initially to FIG. 1 of the drawings. Although the flashing light housing 10 is described below as being removably attached to an athletic shoe 1, such as, for example, a sneaker, sports shoe, training shoe, or the like, it is to be expressly understood that the housing 10 is adapted to be attached to shoes of any type. The athletic shoe 1 illustrated in the drawings is of conventional design and includes a toe portion 2, a heel portion 4, an upper foot support portion 6 and a lower sole portion 8 extending along the bottom of the shoe between the toe and heel portions. As will be described in greater detail hereinafter, a resilient (e.g. rubber) attachment strap 11 (best shown in FIG. 3) having a pair of oppositely extending side bands 12 is connected to the flashing light housing 10 and removably attached to the sole portion 8 of shoe 1, such that housing 10 is held against the heel portion 4 so as to be clearly visible to on-lookers from the rear of the shoe.

More particularly, in the attached relationship of FIG. 1, a transparent lens 16 covers and protects the flashing circuit electronics of the flashing light housing 10. The electronics are retained within the housing 10 by a base (best shown in FIGS. 4 and 5 and designated by reference numeral 30) which is surrounded by the lens 16. An attachment hook 14 projects upwardly from the base 30 of flashing light housing 10 (also best shown in FIG. 4) to fit over and around the top of the heel portion 4 of athletic shoe 1. An elongated slot 18 is formed through each side of the lens 16, and the attachment strap 11 is pulled through the slots 18 so that the flashing light housing 10 and attachment strap 11 are coupled to one another with the side bands 12 of strap 11 projecting laterally outward and in opposite directions from the housing 10.

Figure 2:
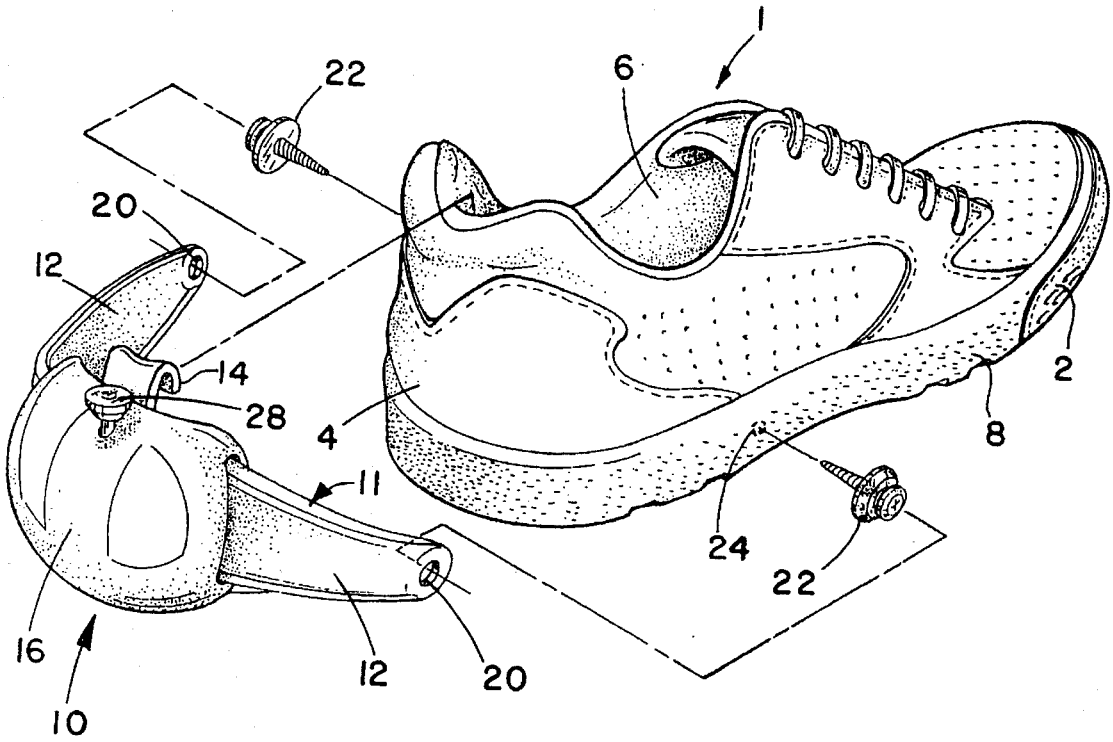
FIG. 2 is an exploded view of the combination flashing light housing and athletic shoe of FIG. 1.

Referring to FIG. 2 of the drawings, where the flashing light housing 10 is shown detached from the athletic shoe 1, a hole 20 is formed through each of the side bands 12 of the attachment strap 11. The holes 20 are sized to receive therethrough the respective shanks of a pair of threaded, screw-like fasteners 22.

Referring concurrently to FIGS. 1 and 2, the flashing light housing 10 is attached to the rear of the athletic shoe 1 by first positioning the attachment hook 14 of base 30 over the top and around the heel portion 4 of shoe 1. Next, threaded fasteners 22 are pushed through respective holes 20 in the side bands 12 of attachment strap 11. The fasteners 20 are then forced (e.g. screwed) into the sole portion 8 at opposite sides of the shoe 1 by making small holes therein (shown in phantom and designated by reference numberal 24 in FIG. 2). Accordingly, in the attached configuration of FIG. 1, the side bands 12 of the attachment strap 11 are reliably secured to opposite sides of the athletic shoe 1 so that the flashing light housing 10 is held against the heel portion 4 with the lens 16 of the flashing light housing 10 suspended (by means of attachment hook 14) at the approximate middle of the heel portion 4.

By virtue of the foregoing, the lens 16 will extend considerably above the surface over which the shoe 1 will travel. Since the lens 16 is not limited in size to the area defined by a preformed cavity in the heel in which conventional light emitting modules are carried, the viewing area provided by lens 16 can be maximized to cover substantially all of the heel 4. Accordingly, the flashing light housing 10 of this invention provides a larger viewing area at the rear of shoe 1 which will be more clearly visible to on-lookers than the viewing area and visibility that characterize previously known light modules.

Projecting from the base 30 of flashing light housing 10 and extending upwardly through an opening (designated 32 in FIG. 4) in the top of the lens 16 is a rotatable light control button 28. As will soon be described, the light control button 28 is suitably positioned so as to be manually operated (i.e. rotated) by the wearer of shoe 1 to open or close an electrical on/off switch. That is, by rotating button 28, the wearer can selectively energize a light source attached to the base 30 and located below the lens 16 of housing 10 so as to correspondingly control the light visible through the lens.

Figure 4:
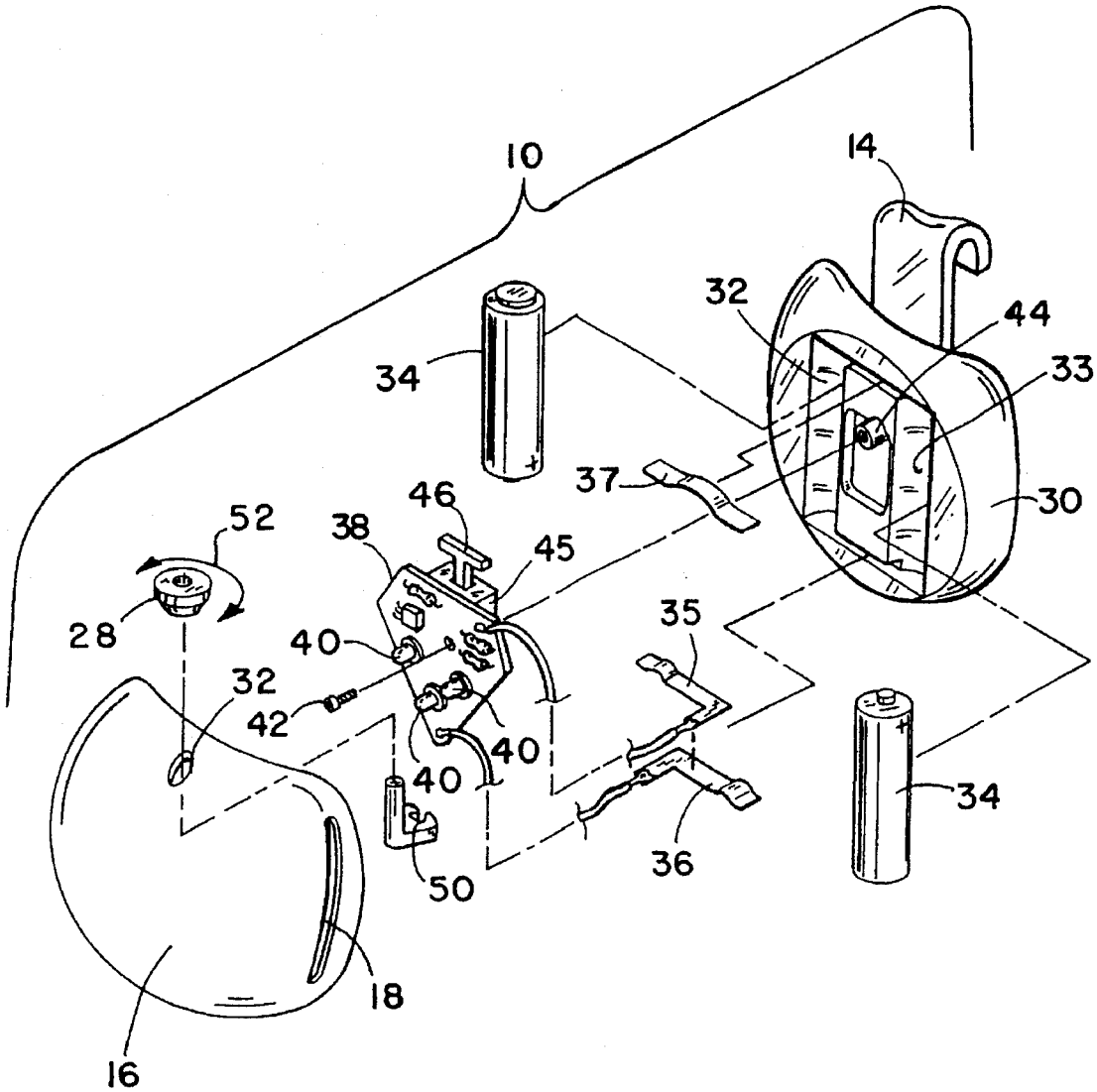
FIGS. 4 and 5 are exploded views of the flashing circuit electronics carried by the flashing light housing for producing a continuous flashing light display that is easily visible to on-lookers.
Figure 5:
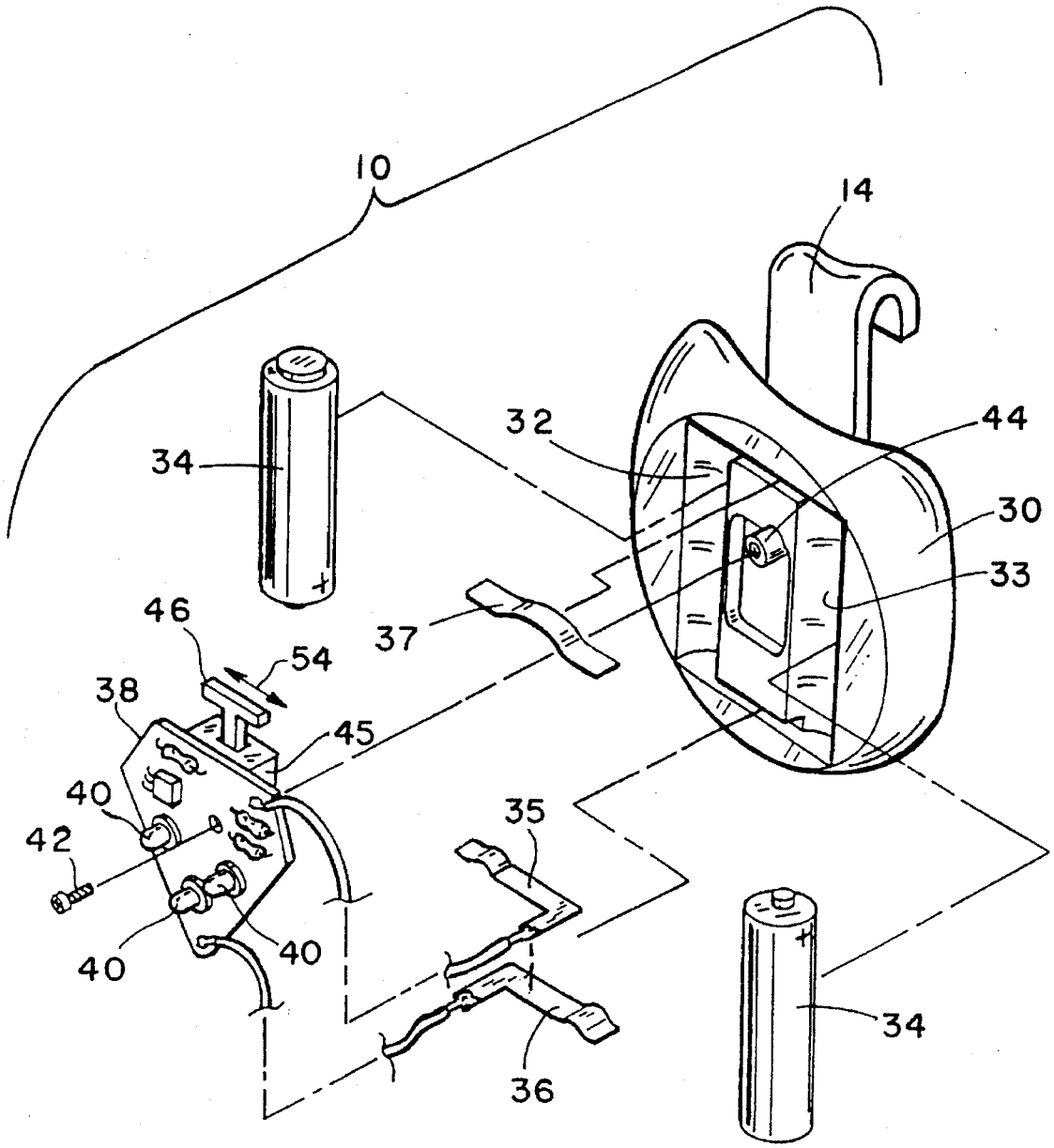

More particularly, and referring now to FIGS. 4 and 5 of the drawings, the base 30 of flashing light housing 10 is shown including a pair of parallel aligned recesses 32 and 33 in which a voltage source is located. Unlike the conventional low profile light modules which utilize expensive lithium batteries, the voltage source of the present invention may consist of a pair of low cost, readily available AAA batteries 34. The batteries 34 are received by the base 30 within respective recesses 32 and 33 between electrical contacts 35, 36 and 37. Contact 37 extends across one end of each of the recesses 32 and 33 to engage opposite terminals of the batteries 34. Contact 35, which is located at the opposite end of a first of the recesses 32, and contact 36, which is located at the opposite end of the second recess 33, are connected by respective wires to an electrical circuit board 38 in order to connect the batteries 34 to the flashing light source.

The flashing light source and the flashing circuit electronics of flashing light housing 10 are electrically interconnected at the circuit board 38. The flashing light source employed herein is preferably a plurality of (e.g. three) well known light emitting diodes (LEDs) 40. While a plurality of LEDs 40 are shown and described to maximize the brightness of the light source, it is to be understood that any number of LEDs may be used to implement the flashing light source at board 38. In the assembled configuration, the circuit board 38 is affixed over top the base 30 of housing 10 by means of a suitable fastener (e.g. a screw 42) passing through an opening in board 38 for receipt by a threaded post 44 extending from the base 30.

Mounted on circuit board 38 is an on/of switch 45 that is connected in the electrical flashing circuit to complete or break a conductivity path between the batteries 34 and the LEDs 40. The on/off switch 45 includes a T-shaped striker 46 which projects upwardly from the circuit board 38 and is supported for back and forth (i.e. linear) movement to close or open on/off switch 45. The aforementioned rotatable light control button 28 that is manually accessible outside the lens 16 is connected to the striker 46 by means of an L-shaped arm 48. That is, one end of the L-shaped arm 48 projects upwardly through the hole 32 (best shown in FIG. 4) in the lens 16 to be attached to the light control button 28. The other end of the L-shaped arm 48 includes a catch 50 which is adapted to engage the T-shaped striker 46 at a vertically extending neck thereof below a horizontally extending head. The engagement of the striker 46 by the catch 50 of arm 48 permits the light control button 28 to communicate with the on/off switch 45 of the circuit board 38, such that a rotation of the light control button 28 (in one of the directions indicated by the reference arrows 52 of FIG. 4) is translated via the arm 48 into a corresponding linear movement of the striker 46 (in one of the directions indicated by the reference arrows 54 of FIG. 5), whereby to close or open the on/off switch 45 and thereby energize or deenergize the LEDs 40.

The flashing light circuit mounted on circuit board 38 for supplying battery power to the LEDs 40 through on/off switch 45 is conventional and will not be described in detail. Briefly, however, all three of the LEDs 40 are fired in unison to emit a relatively bright light. Moreover, it is desirable to regulate the supply of battery power to the LEDs 40 by means of a switching transistor (not shown), or the like, to cause the LEDs to flash. Therefore, when the light control button 28 is rotated in a first direction to close on/off switch 45, the LEDs 40 will continue to flash, whether the wearer is walking, running or standing still, until button 28 is rotated in an opposite direction to open switch 45 and thereby deenergize the LEDs 40.

By virtue of the foregoing, and unlike conventional light modules, the flashing light circuit is not responsive to a heel-strike pressure, on one hand, while the wearer will be able to selectively disable the light source to as to conserve energy and minimize the need to replace the batteries, on the other hand. The flashing circuit may also include an optional photodetector (also not shown) which is sensitive to ambient light so that the light source will be disabled (regardless of the position of the on/off switch 45) in bright daylight to better avoid inefficient battery consumption.

The relatively bright light generated by LEDs 40 will be visable to on-lookers through the lens 16 which surrounds the flashing circuit electronics on circuit board 38. To this end, lens 16 may be either colored or amber according to the aesthetic wishes of the wearer. The lens 16 is retained atop the base 30 of flashing light housing 10 by means of the pulling force applied thereto when the resilient attachment strap 11 passes through the slots 18 in lens 16 for attachment to the sole portion 8 of shoe 1 (in the manner previously described while referring to FIG. 2). In this regard, the batteries 34 of the flashing light circuit may be changed easily and safely by simply detaching one of the side bands 12 of attachment strap 11 from the sole portion 8 and lifting the lens 16 off base 30.

Similarly, the flashing light housing 10 may be quickly and easily removed from the athletic shoe 1 to which it is attached so as to be either placed in storage or relocated to any other suitable shoe. The foregoing is achieved by simply removing the fasteners 22 (of FIGS. 1 and 2) from the sole portion 8 and unhooking the attachment hook 14 from the heel portion 4. However, it may be appreciated that no factory alterations (e.g. preformed light module cavities) are required in a shoe before the housing 10 can be attached thereto.

It will be apparent that while a preferred embodiment of the invention has been shown and described, various modifications and changes may be made without departing from the true spirit and scope of the invention.

Having thus set forth the preferred embodiment, what is claimed is:

1. For attachment to a shoe having a toe portion at one end, a heel portion at the opposite end and a sole extending between the toe and heel portions, a light housing comprising:

a voltage source;

a light source;

electronic circuit means to connect said voltage source to said light source;

lens means surrounding said voltage source, said light source and said electronic circuit means, said lens means having an opening extending therethrough;

manually operable switch means connected in said electronic circuit means and being movable between closed and opened switch positions to either energize said light source or disable said light source;

a movable switch control button located at a manually accessible side of said lens means, such that a movement of said switch control button in a first direction moves said switch means to said closed switch position to energize said light source, and a movement of said switch control button in an opposite direction moves said switch means to said opened switch position to disable said light source;

a switch arm extending through the opening in said lens means and connected between said movable switch control button at the manually accessible side of said lens means and said switch means at the opposite side of said lens means, said switch arm translating a movement of said switch control button into a corresponding movement of said switch means to said closed or opened switch positions;

first attachment means by which to suspend said lens means from the heel of the shoe; and second attachment means by which to couple said lens means to each of a first side and an opposite side of the shoe at locations between the toe and heel portions thereof.

2. The light housing recited in claim 1, further comprising a base to support said voltage source, said light source and said electronic circuit means, said lens means being attached to said base with said voltage source, said light source and said electronic circuit means located therebetween.

3. The light housing recited in claim 2, wherein said first attachment means includes an attachment hook extending from said base and adapted to be positioned over the top of the heel of the shoe by which said lens means is suspended from said heel.

4. The light housing recited in claim 1, wherein said second attachment means includes an attachment band connected to said lens means and having first and second ends projecting outwardly from said lens means, said light housing further comprising means by which to respectively attach said first and second ends of said attachment band to the first and opposite sides of the shoe.

5. The light housing recited in claim 4, wherein said lens means has at least one slot formed therein, said attachment band connected to said lens means through said at least one slot.

6. The light housing recited in claim 4, wherein said means to attach said first and second ends of said attachment band to the first and opposite sides of the shoe include first and second fasteners connected to respective ones of said first and second ends of said attachment band.

7. The light housing recited in claim 6, wherein said first and second fasteners are threaded screws.

8. The light housing recited in claim 1, wherein said light source includes at least one light emitting diode.

9. The light housing recited in claim 1, wherein said voltage source includes at least one AAA battery.

10. The light housing recited in claim 1, wherein said manually operable switch means includes elongated striker means connected between said switch arm at said opposite side of said lens means and said electronic circuit, said striker means adapted for back and forth movements relative to said circuit means in response to the movements of said switch control button in said first and opposite directions to either energize or disable said light source.

11. For attachment to a shoe having a toe portion at one end, a heel portion at the opposite end, and a sole extending between the toe and heel portions, a light housing comprising:

a voltage source;

a light source;

electronic circuit means to connect said voltage source to said light source;

a base at which to support said voltage source, said light source and said electronic circuit means;

lens means attached to said base to surround said voltage source, said light source and said electronic circuit means;

manually operable switch means connected in said electronic circuit means and being movable between closed and opened switch positions to either energize said light source or disable said light source;

attachment means connected to said lens means and adapted to be connected to the sole of the shoe at each of a first side and an opposite side thereof in order to secure said lens means and said base against the heel of the shoe; and first and second threaded screws extending through said attachment means for receipt by respective ones of said first and second sides of the sole for connecting said attachment means to the sole and securing said lens means and said base against the heel of the shoe.

12. The light housing recited in claim 11, further comprising an attachment hook extending from said base and adapted to be positioned over the top of the heel of the shoe by which to suspend said lens means from said heel.

13. The light housing recited in claim 11, further comprising:

a movable switch control button located at a manually accessible side of said lens means, such that a movement of said switch control button in a first direction moves said switch means to said closed switch position to energize said light source, and a movement of said switch control button in an opposite direction moves said switch means to said opened switch position to disable said light source; and a switch arm extending through said lens means and connected between said movable switch control button at the manually accessible side of said lens means and said switch means at the opposite side of said lens means, said switch arm translating a movement of said switch control button into a corresponding movement of said switch means to said closed or opened switch positions.

14. In combination:

a shoe having a toe portion at one end, a heel potion at the opposite end and a sole extending between the toe and heel portions; and a light housing having a base and a voltage source, a light source and an electronic circuit to connect said voltage source to said light source to energize said light source, said base supporting said voltage source, said light source and said electronic circuit, said light housing comprising:

lens means surrounding said base and thereby enclosing said voltage source, said light source and said electronic circuit supported by said base, first attachment means coupled to said lens means and attached to the heel of said shoe by which to suspend said lens means from said heel, and second attachment means coupled to said lens means and attached to the sole of said shoe by which to secure said lens means against the heel of said shoe.

15. The combination recited in claim 14, wherein said light housing also comprises manually operable circuit control means extending from a manually accessible location at one side of said lens means to said electronic circuit at an opposite side of said lens means, said circuit control means being movable between first and second positions to either connect or disconnect said light source to said voltage source.

16. For attachment to a shoe having a toe portion at one end, a heel portion at the opposite end, and a sole extending between the toe and heel portions, a light housing comprising:

a voltage source;

a light source;

electronic circuit means to connect said voltage source to said light source;

a base at which to support said voltage source, said light source and said electronic circuit means;

lens means attached to said base to surround said voltage source, said light source and said electronic circuit means;

manually operable switch means connected in said electronic circuit means and being movable between closed and opened switch positions to either energize said light source or disable said light source;

attachment means connected to said lens means and adapted to be connected to the sole of the shoe at each of a first side and an opposite side thereof in order to secure said lens means and said base against the heel of the shoe;

first and second connectors extending through said attachment means for receipt by respective ones of said first and second sides of the sole for connecting said attachment means to the sole and securing said lens means and said base against the heel of the shoe; and an attachment hook extending from said base and adapted to be positioned over the top of the heel of the shoe by which to suspend said lens means from said heel.

* * * * *